US005746687A

United States Patent [19]

Vial et al.

[11] Patent Number: 5,746,687

[45] Date of Patent: May 5, 1998

[54] MULTI-PURPOSE EXERCISE DEVICE

[76] Inventors: Silvano Vial; Maria Vial, both of 84 Euclid Ave., Atheron, Calif. 94025

[21] Appl. No.: 534,423

[22] Filed: Sep. 27, 1995

[51] Int. Cl.[6] ..... A63B 21/02

[52] U.S. Cl. ..... 482/126; 482/125; 482/82

[58] Field of Search ..... 482/82, 126, 121, 482/125

[56] References Cited

U.S. PATENT DOCUMENTS

| | | | |
|---|---|---|---|
| 4,090,706 | 5/1978 | Reda . | |
| 4,423,866 | 1/1984 | Stolba | 482/82 |
| 4,690,401 | 9/1987 | Cho . | |
| 4,733,861 | 3/1988 | Plunkett, III . | |
| 4,872,666 | 10/1989 | Smith | 482/82 |
| 5,131,650 | 7/1992 | Hall . | |
| 5,190,512 | 3/1993 | Curran . | |
| 5,314,396 | 5/1994 | Parr . | |
| 5,342,273 | 8/1994 | Plendl . | |

FOREIGN PATENT DOCUMENTS

| | | |
|---|---|---|
| 2707545 | 2/1977 | Germany . |

*Primary Examiner*—Lynne A. Reichard

*Attorney, Agent, or Firm*—Townsend & Towsend & Crew

[57] ABSTRACT

A method and apparatus for coupling a tubular handle (4, 6) of an exercise device to a flexible line (10), such as an elastic cord, is described. The elastic flexible line is directed through a circumferential opening (60) in the handle and attached to the inner lumen of the handle with a coupling assembly (24). The coupling assembly comprises a retainer (30) defining a hole (40) for receiving the end portion of the flexible line and fastener (32) for securing the end portion of the flexible line to the retainer to thereby fix the line to the handle. The coupling assembly provides a strong mechanical link between the flexible elastic line and the handle that minimizes wear on the elastic line.

14 Claims, 5 Drawing Sheets

MULTI-PURPOSE EXERCISE DEVICE

BACKGROUND OF THE INVENTION

This invention relates to exercise equipment generally, and more specifically to a method and apparatus for coupling a flexible line, such as an elastic cord, to a pair of tubular metal handles in a multi-purpose exercise device.

In recent years, public education concerning health has sparked renewed interest in individual programs of diet and regular exercise. Consequently, a large variety of exercise machines and devices have recently become available to the public. These machines include a variety of stationary devices, such as rowing machines, stationary bicycles or elaborate universal machines for weight lifting. In addition, various types of portable exercise devices for the development of hand, wrist, leg, arm and shoulder muscles are currently available from a variety of sources.

Portable exercise devices have become more popular because they are generally inexpensive to manufacture and are readily transportable so that a regular program of physical fitness can be maintained. These portable devices often include one or more rigid tubes or handles coupled together by a flexible line, such as an elastic cord. The elastic cord provides a variable resistance to movement of the handles so that the operator may develop his/her muscles by manipulating the handles in a prescribed manner. For example, U.S. Pat. No. 4,733,861, to Plunkett, the complete disclosure of which is incorporated herein by reference, describes an exercise device comprising a pair of cylindrical handles coupled to an elastic cord that can be manipulated to modify the length and shape of the cord. The patent illustrates a variety of exercises performed with the device, such as the bench press, the military press, pull-ups, etc.

Among the drawbacks with existing portable exercise devices is that it is difficult to adequately couple the flexible elastic line to the tubular handles. In a typical portable exercise device, a substantial portion of the tensile force exerted by the user on the elastic line is directly applied to the mechanical link between the line and the tubular handles. After many repetitions, this mechanical link may not be strong enough to repeatedly withstand these relatively strong and concentrated tensile forces.

Another drawback with existing devices is that the elastic line typically contacts the rigid handles directly at the point of pressure generated by the tensile force in the flexible line. This contact creates surface friction between the handle, which is typically constructed of a light weight metal, and the elastic line. Continuous wearing of the elastic line against the metal handle may cause it to eventually fail and snap back at the operator at a high velocity, possibly resulting in serious injury.

SUMMARY OF THE INVENTION

The present invention is directed to a method and apparatus for coupling a tubular handle of an exercise device to a flexible line, such as an elastic cord. The present invention provides a relatively strong mechanical link between the handle and the flexible line that will effectively withstand the concentrated stress placed on the link during use of the exercise device. In addition, the present invention is configured to reduce contact between the flexible line and the handle, thereby minimizing wear on the line.

The apparatus comprises at least one rigid handle of an exercise device and an elastic flexible line having an end portion extending through a circumferential opening in the handle. The flexible line is secured within an inner lumen of the handle by a coupling assembly. A coupling assembly comprises a retainer positioned within an inner lumen of the handle and defining a hole for receiving the end portion of the flexible line. The coupling assembly further includes a fastener for securing the end portion of the flexible line to the retainer to thereby fix the line to the handle.

In a specific configuration, the retainer comprises a guide portion, such as a bull-nosed end portion, for guiding the retainer through the open end of the handle. In addition, the retainer defines a lip projecting from one of its surfaces around the hole. The lip is sized to minimize contact between the flexible line extending through the hole and the handle. This reduces the surface friction between the handle and the line, thereby decreasing the wear on the line and increasing its lifetime.

The fastener is preferably a conically shaped screw having a first end extending through an open end of the flexible line. The screw comprises a second end with a larger diameter than a diameter of the retainer hole for inhibiting the screw from passing through the retainer hole to thereby prevent the flexible line from being released from the retainer. Preferably, the second end comprises a protruding lip that abuts against the retainer wall to prevent passage of the screw through the retainer hole. The screw may also include a ridge protruding from the screw and forming a spiral shape towards the first end of the screw for gripping onto an inner wall surface of the flexible line. This spiral ridge digs into the flexible line, providing a strong mechanical link therebetween.

The method of the present invention comprises directing an end portion of the flexible line through the circumferential opening in the handle and guiding the end portion through a hole in the retainer. The end portion is then fastened to the retainer and the retainer is positioned within the inner lumen of the handle to thereby fix the flexible line to the handle. Preferably, the end portion of the line is fastened to the retainer by inserting a first end of the conical screw through an open end of the flexible line and gripping the inner wall of the flexible line with a spiral ridge protruding from the screw. One of the advantages of this method is that the screw and the retainer can be easily replaced by engaging a lip on the screw with, e.g., a pair of pliers, withdrawing the screw from the flexible line and guiding the line back through the hole in the retainer.

Other features and advantages of the invention will appear from the following description in which the preferred embodiment has been set forth in detail in conjunction with the accompanying drawings.

DESCRIPTION OF THE PREFERRED EMBODIMENTS

Figure 1:
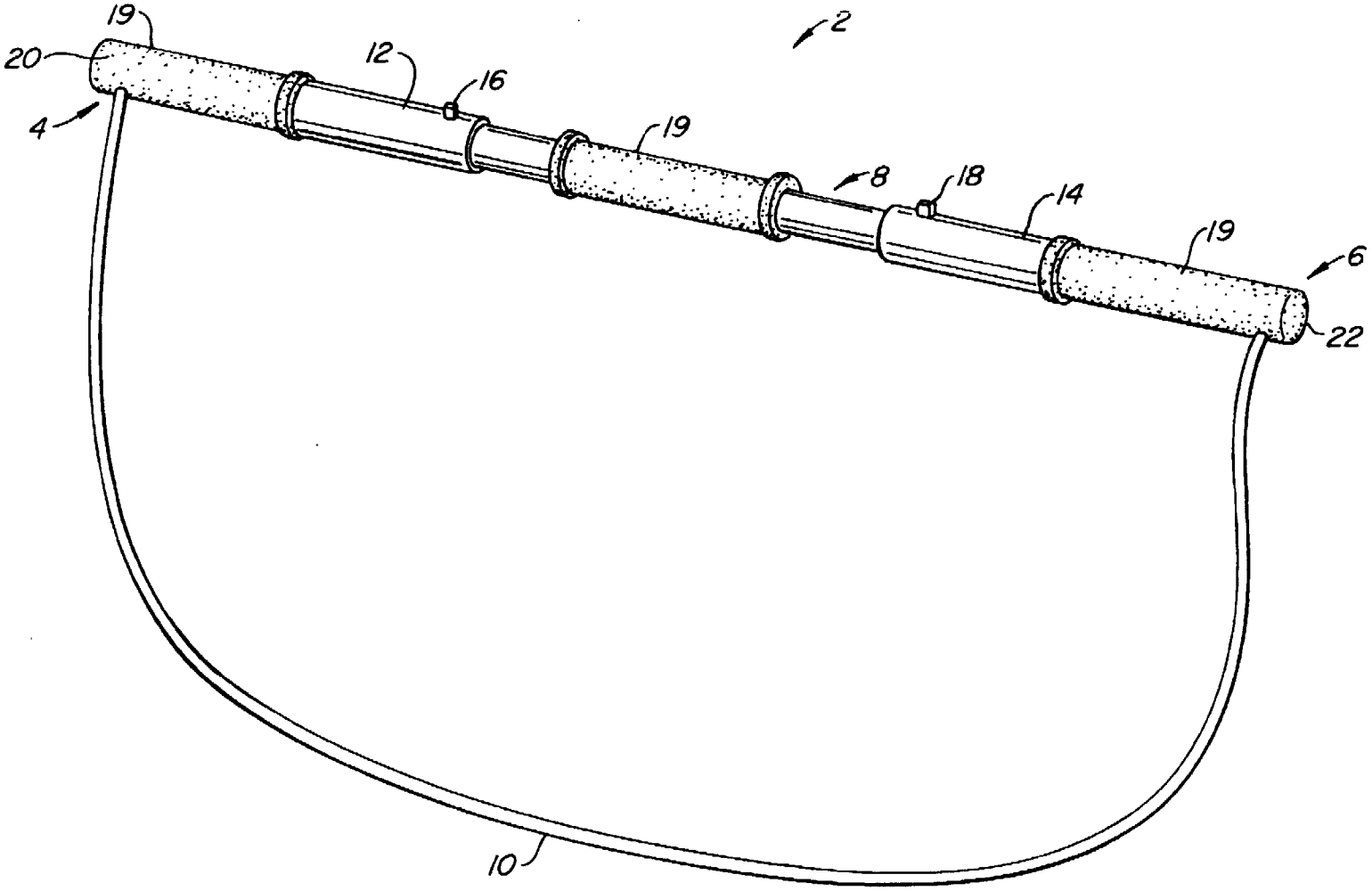
FIG. 1 is a perspective view of a representative multi-purpose exercise device incorporating a coupling assembly according to the principles of the present invention.

Referring to the drawings in detail, wherein like numerals indicate like elements, a multi-purpose exercise device 2 is illustrated according to the principles of the invention. Exercise device 2 generally includes a pair of rigid longitudinal handles 4, 6 telescoping with a center bar 8 and attached to an elastic flexible line 10.

Figure 2A:
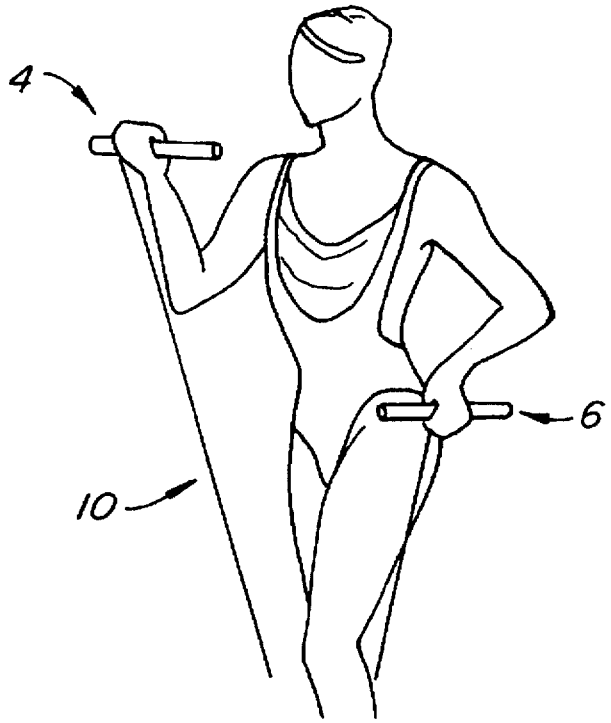
FIGS. 2A–2E are schematic views illustrating various exercises performed with the exercise device of FIG. 1.

Referring to FIGS. 1 and 3A–3C, handles 4, 6 each comprise an elongated cylindrical body 12, 14 preferably constructed of metal, such as aluminum or stainless steel. Preferably, cylindrical bodies 12, 14 have substantially identical diameters and lengths to facilitate use of the device when handles 4, 6 are separated from bar 8 (discussed below, see FIG. 2A). Center bar 8 includes a release button 16, 18 for releasably attaching handles 4, 6 to center bar 8. Release buttons 16, 18 include compressed springs (not shown) having protrusions that extend through corresponding holes in handles 4, 6, to lock the handles to center bar 8, thereby preventing them from rotating relative to bar 8 and pulling apart from the center bar. Release buttons 16, 18 allow the operator to either use device 2 as a composite bar (as shown in FIG. 1) or to separate handles 4, 6 from center bar 8 for a variety of other exercises (FIG. 2A).

Center bar 8 is a metal cylindrical tube having a smaller outer diameter than the inner diameter of handles 4, 6 so that bar 8 can telescope within handles 4, 6. Handles 4, 6 and center bar 8 may also include grip sleeves 19 made out of an elastomeric material, such as rubber, for facilitating operator gripping of the handles 4, 6 and center bar 8 during use of exercise device 2. Preferably, the composite length of bar 8 and handles 4, 6 when coupled together as shown in FIG. 1 is approximately equal to the shoulder span of an adult.

Figures 3A, 3B, 3C:
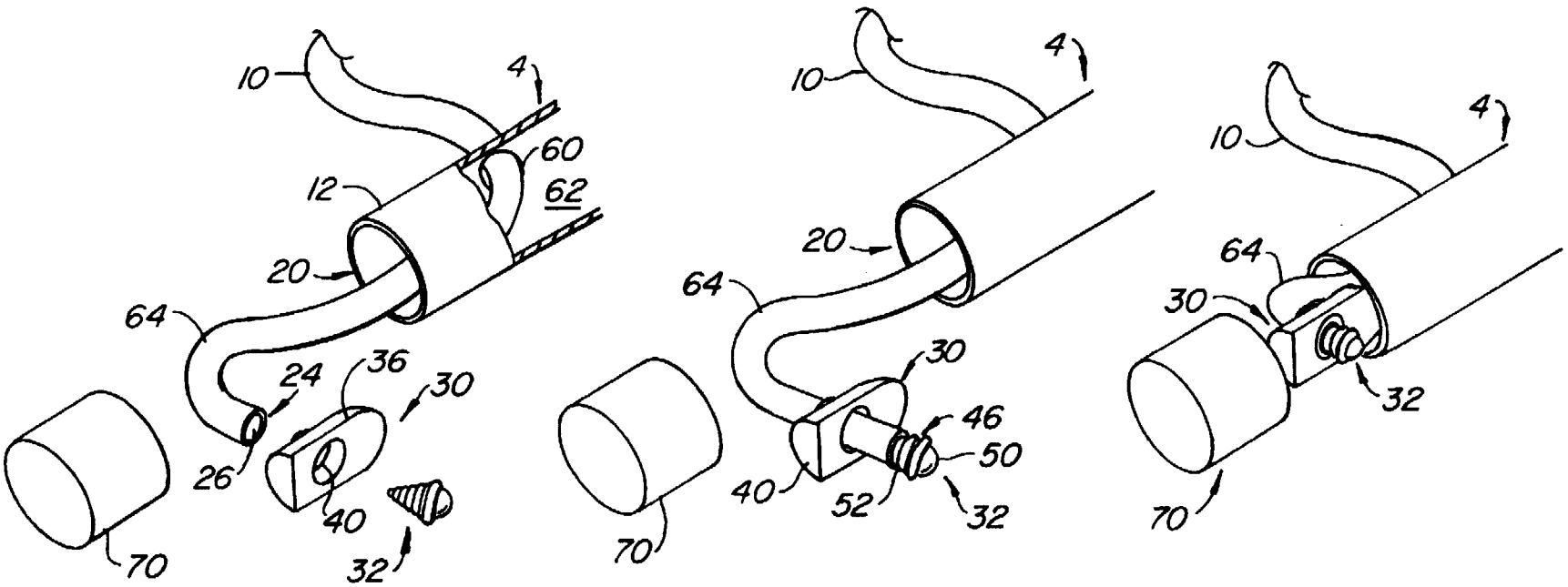
FIGS. 3A–3C are side views of the coupling assembly of FIG. 1, illustrating the method according to the present invention of coupling a flexible elastic line to a rigid handle.

Line 10 is removably coupled to line receiving ends 20, 22 of handles 4, 6 by a coupling assembly 24, described in more detail below (see FIGS. 3A–3C). Line 10 may be a solid or tubular rubber, latex or any other suitable elastic flexible material which will not be permanently deformed upon the full extension of the user's arms, such as elastic synthetic rubber, elastic nylon cord or other elastic cording. Line 10 will preferably have a sufficient length, in a non-stressed configuration, so that the distance from the handles 4, 6 to the middle of the line is slightly less than the waist height of an operator. The length of line 10 may also be varied by the user to produce the desired resistive or tension force to the displacement of handles 4, 6. As shown in FIGS. 3A–3C, line 2 preferably has open ends 24 and inner lumens 26 in communication with the open ends 24 (note that only one open end and inner lumen is shown in FIGS. 3A–3C). Line 10 may also include a solid rubber or nylon insert extending through the outer tube between the inner lumens 26 on either end of the line.

Figure 2B:
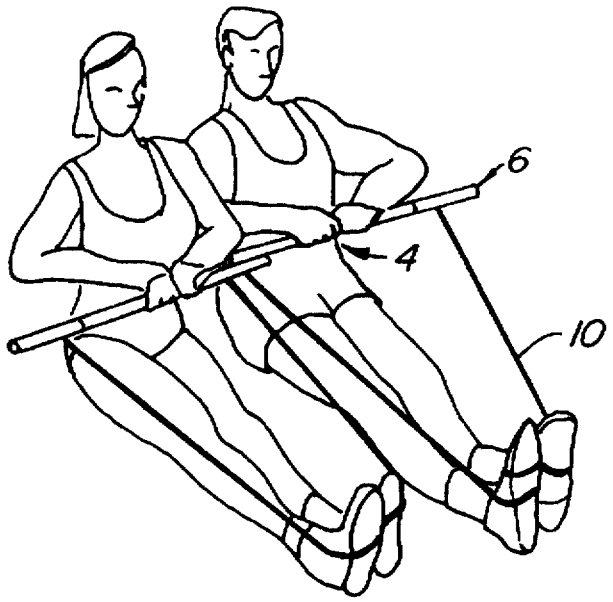
Figure 2C:
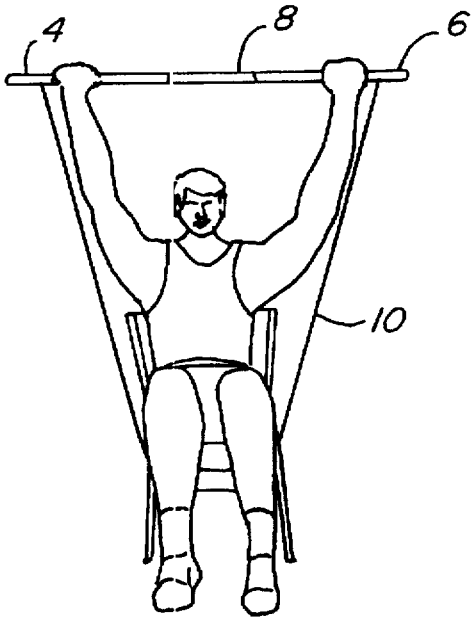
Figure 2D:
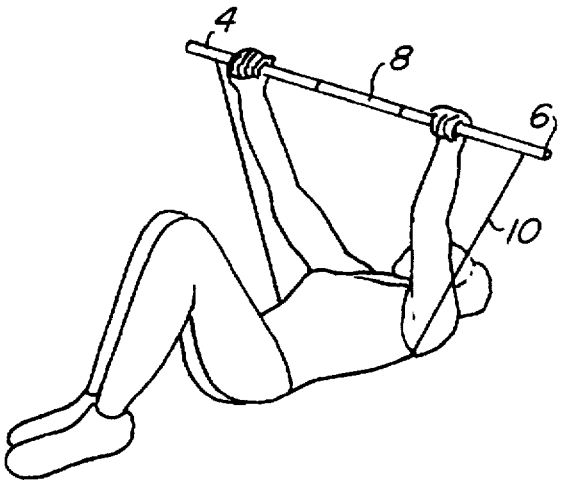
Figure 2E:
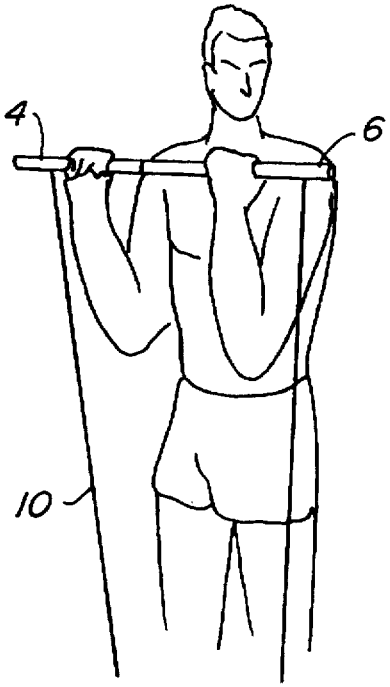

Referring to FIGS. 2A–2E, exercise device 2 may be used for a variety of muscle development and/or aerobic exercises. For example, an operator may stand on line 10 with handles 4, 6 (or bar 8) grasped by the operator's hands. In this position, the operator can draw the handles towards his/her chest to perform a strength exercise commonly known as the bicep curl, as shown in FIG. 2E. An operator may also lie on the line 10 or position the line underneath a chair to perform other muscle development exercises, such as the military press or the bench press (see FIGS. 2C and 2D). Alternatively, the device may be used for an aerobic type exercise. For example, FIG. 2B illustrates two operators using the exercise device as a rowing machine.

FIG. 2A illustrates one of the exercises that may be performed with handles 4, 6 removed from center bar 8. To remove handles 4, 6, release buttons 16, 18 are pressed and the handles are slid outward away from bar 8. In this example, the operator stands on line 10 and alternatively pulls each handle 4, 6 in the vertical direction to work the biceps or triceps. It should be noted that the above described exercises are merely representative. For example, the present invention can be used to perform a variety of exercises, such as the dead lift, hamstring press, upright row, squats, hip rotators, side bends, tricep extensions, lunges, upper body rotations, straddles, lat pulls, leg presses, etc.

Figure 4:
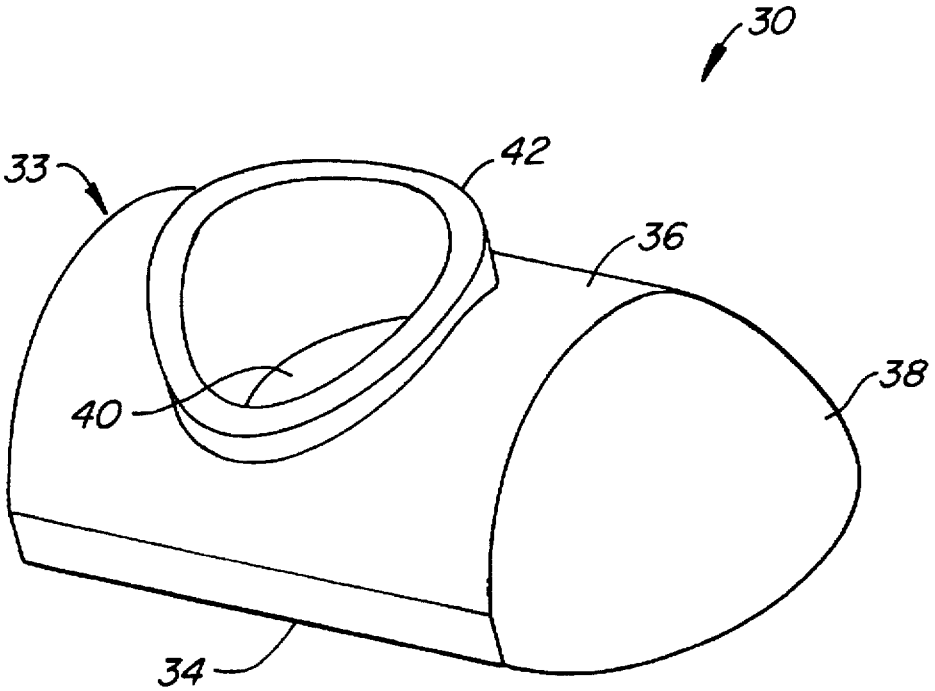
FIG. 4 is a perspective view of a retainer of the coupling assembly of FIGS. 3A–3C.
Figure 5:
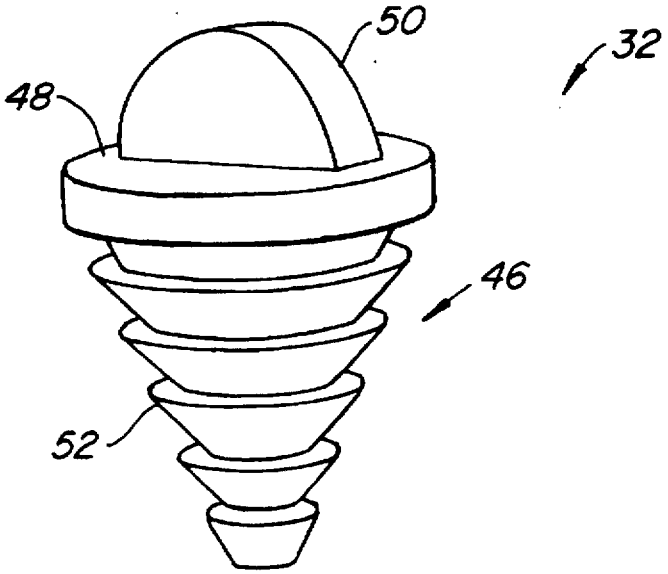
FIG. 5 is a perspective view of a fastener of the coupling assembly of FIGS. 3A–3C.

FIGS. 3–5 illustrate the novel apparatus and method for coupling line 10 to handles 4, 6 of the present invention. Coupling assembly 24 comprises a retainer 30 (FIG. 4) and a fastener 32 (FIG. 5). Retainer 30 includes an elongate body member 33 preferably constructed of molded plastic and having a planar wall 34 and an opposite arcuate wall 36. Retainer 30 includes an end portion 38 preferably having a bull-nosed shape for guiding retainer 32 into one of the handles 4, 6, as discussed below. Retainer 30 further includes a hole 40 extending through body member 33 and having a larger inner diameter than the outer diameter of line 10 so that line 10 can be inserted through hole 40.

Retainer 30 includes a raised lip 42 protruding from arcuate wall 36 and extending around the circumference of hole 40. Lip 42 functions to minimize contact between the point on line 10 where pressure is applied and the inner metal surface of the handles after the handles have been coupled to line 10. Thus, when an operator pulls on the elastic line, the tensile force causes the line to rub or wear against the plastic retainer, rather than the metal handle. The friction between the plastic retainer and the elastic line is substantially less than the friction between the metal handle and the elastic line. This increases the lifetime of the line 10, thereby minimizing potential injuries caused by the failure of line 10.

Referring to FIG. 5, fastener 32 is preferably a screw that functions as a stopper for preventing the release of line 10 through hole 40 in retainer 30. To that end, fastener 32 comprises a generally conical body 46 with a stopper disc 48 at one end. Disc 48 has a larger outer diameter than the inner diameter of hole 40 so that fastener 32 cannot be pulled through hole 40. Disc 48 further includes a lip 50 protruding outward therefrom to facilitate gripping of fastener 32 with, for example, a pair of pliers. To facilitate the connection between fastener 32 and flexible line 10, fastener 32 includes a ridge 52 protruding outward from conical body 46 in a spiral shape. Ridge 52 grips the inner surface of line 10 to resist tension as the line 10 is pulled away from fastener 32 during use of the device.

Referring to FIGS. 3A–3C, the method for coupling line 10 to handles 4, 6 will now be described in detail. Line 10 is fed through a circumferential opening 60 in body 12, directed through an inner lumen 62 and out of line receiving end 20 of handle 4, as shown in FIG. 3A. Line 10 is suitably bent to form a partially kinked portion 64 near open end 24 to facilitate holding line 10 within inner lumen 62 of handle 4. As shown in FIG. 3B, retainer 30 is positioned with arcuate wall 36 facing line 10 and line 10 is guided through hole 40 in retainer 30. Lip 50 of fastener 32 can then be grasped by suitable means, e.g., pliers, and conical body 46 is compressed into lumen 26 of the elastic line 10. The spiral ridge 52 on fastener 32 grips the inner surface of line 10 to bond fastener 32 to line 10.

As shown in FIG. 3C, line 10 is pulled taut until fastener 32 engages planar wall 34 of retainer 30, thereby preventing further pulling of line 10. Coupling assembly 24 is then guided into the open end of line 10. The kinked portion 64 of line 10 and the lip 50 of fastener 30 provide a frictional fit with the inner walls of handle 4 so that elastic line 10 cannot be pulled further through circumferential opening 60. If the kinked portion 64 unravels, however, retainer 30 will not be pulled through opening 60 and fastener 32 ensures that line 10 remains fixed to the retainer 30. After the line 10 and coupling assembly 24 are suitably positioned within handle 4, a cap 70 may be placed over open end 20 to seal coupling assembly 24 within the handle.

The above is a detailed description of various embodiments of the invention. It is recognized that departures from the disclosed embodiments may be made within the scope of the invention and obvious modifications will occur to a person skilled in the art. The full scope of the invention is set out in the claims that follow and their equivalents. Accordingly, the claims and specification should not be construed to unduly narrow the full scope of protection to which the invention is entitled.

What is claimed is:

1. An exercise device comprising:

a rigid tube defining an open end and an inner lumen in communication with the open end, the tube defining a circumferential opening spaced from the open end;

an elastic flexible line having an end portion extending through the circumferential opening into the inner lumen of the tube;

a retainer positioned within the inner lumen for connecting the flexible line to the tube, the retainer defining a hole for receiving the end portion of the flexible line;

a fastener securing the end portion of the flexible line to the retainer; and wherein the retainer comprises a guide portion shaped for guiding the retainer through the open end of the tube, the guide portion comprising a bull-nosed end portion.

2. The device of claim 1 wherein the flexible line comprises an open end and an inner lumen in communication with the open end, the fastener comprising a screw having a first end extending through the open end and into the inner lumen of the flexible line, the screw comprising a second and with a larger diameter thana diameter of the retainer hole for inhibiting the screw from passing through the retainer hole.

3. The device of claim 2 wherein the first end of the screw comprises gripping means for coupling the screw to the flexible line.

4. The device of claim 3 wherein the gripping means comprises a ridge protruding from the screw and forming a spiral shape towards the first end of the screw for gripping onto an inner wall surface of the flexible line.

5. The device of claim 2 wherein the screw is substantially conical and comprises a lip on the second end sized to prevent the screw from passing through the retainer hole.

6. The device of claim 1 wherein the tube is a metal handle.

7. The devie of claim 1 wherein the flexible line comprises an elastic coil.

8. An exercise device comprising:

a rigid tube defining an open end and an inner lumen in communication with the open end, the tube defining a circumferential opening spaced from the open end;

an elastic flexible line having an end portion extending through the circumferential opening into the inner lumen of the tube;

a retainer positioned within the inner lumen for connecting the flexible line to the tube, the retainer defining a hole for receiving the end portin of the flexible line; and a fastener securing the end portion of the flexible line to the retainer;

wherein the retainer defines a first, generally planar surface and an opposite, arcuate surface, the flexible line extending through the retainer from the arcuate surface to the planar surface, the fastener being disposed adjacent the planar surface for securing the line within the hole.

9. The device of claim 8 wherein the retainer further comprises a lip projecting from the arcuate surface, the lip surrounding the hole and being sized to minimize contact between the flexible line and the tube.

10. A method for coupling an elastic flexible line to a rigid handle of an exercise device, the method comprising:

directing an end portion of the flexible line through circumferential opening in the rigid handle;

guiding the end portion through a hole in a retainer;

fastener the end portion the retainer; and positioning the retainer within an inner lumen of the handle to thereby fix the flexible line to the handle by inserting a bull-nosed end of the retainer through an open end of the rigid handle.

11. The method of claim 10 wherein the guiding step comprises inserting the end portion of the flexible line through an inlet of the hole at a wall surface of the retainer and delivering the line through an outlet of the hole on an opposite wall surface of the retainer.

12. The method of claim 11 wherein the fastening step comprises inserting a first end of a screw through an open end of the flexible line and gripping the flexible line with a spiral ridge protruding from the first end.

13. The method of claim 12 further comprising the step of abutting a lip of the screw againstthe opposite wall surface of the retainer to prevent the screw and the end portion of the flexible line from passing through the retainer hole.

14. The method of claim 12 wherein the inserting step comprises grasping the lip and compressing the screw into the inner passage of the flexible line.

* * * * *